US006367514B1

(12) United States Patent
Demey

(10) Patent No.: US 6,367,514 B1
(45) Date of Patent: Apr. 9, 2002

(54) FALSE BOUCLÉ FABRICS WITH CUT PILE AND/OR PILE LOOPS, AND METHOD FOR THE WEAVING THEREOF

(75) Inventor: Stefaan Demey, Brugge-St. Michiels (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/625,308

(22) Filed: Jul. 25, 2000

(30) Foreign Application Priority Data

Aug. 31, 1999 (BE) ..... 09900584

(51) Int. Cl.[7] ..... D03D 27/06

(52) U.S. Cl. ..... 139/404; 139/403; 139/406; 139/408

(58) Field of Search ..... 139/404, 394, 139/406, 403, 43, 408, 402, 37, 435.1, 2; 28/1, 72

(56) References Cited

U.S. PATENT DOCUMENTS 1,932,981 A 10/1933 Milnes
3,004,564 A 10/1961 Nowicki
3,060,974 A 10/1962 Hoffman

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

A fabric with a rib structure, in particular a false boucle carpet, with cut pile (13) and/or pile loops (12) is formed by a method for weaving such a fabric. On a weaving machine, such as a rod weaving machine, a backing fabric is woven by bringing weft yarns (1), (2), (3) between warp yarns (4–9) in successive weft insertion cycles, alternately weaving in warp yarns (7), (8) in the backing fabric and rib-formingly passing them around over at least one weft yarn (3). In a number of weft insertion cycles a loop-forming element (10), such as for example a wire or a wire with a blade, is provided above the backing fabric and at least one pile warp yarn (7), (8) is loop-formingly passed around over this loop-forming element (10). This method enables weaving of a fabric with a very varied appearance, because apart from the false boucle effect, areas with pile loops (12) and/or areas with cut pile (13) can also be obtained.

14 Claims, 1 Drawing Sheet

FALSE BOUCLÉ FABRICS WITH CUT PILE AND/OR PILE LOOPS, AND METHOD FOR THE WEAVING THEREOF

BACKGROUND OF THE INVENTION

This invention relates to a method for weaving fabrics with a rib structure, whereby on a weaving machine a backing fabric is woven by bringing weft yarns between warp yarns in successive weft insertion cycles, and whereby warp yarns are alternately woven into the backing fabric and are rib-formingly passed around over at least one weft yarn.

This invention also relates to fabrics with a rib structure, and more especially to fabrics which approximate the appearance of a loop pile fabric or bouclé fabric, and are in general referred to by the name of "false bouclé fabrics", in which warp yarns are alternately woven into the fabric and are rib-formingly passed around at least one weft yarn.

This invention relates in particular to a so-called false bouclé carpet and a weaving method for manufacturing such a carpet.

According to a known method for manufacturing these types of carpets on a weaving machine a series of warp yarn systems are provided and in successive weft insertion cycles in each case two weft yarns are inserted one above the other in respective sheds between these warp yarns. Each warp yarn system comprises two pattern warp yarns and a tight warp yarn. With each weft insertion these warp yarns are brought into such positions in relation to the weft insertion levels that the pattern warp yarns cross over the weft yarns, so that a fabric is formed, in which tight warp yarns are woven, in which the pairs of weft yarns inserted in successive cycles extend alternately along the upper side and along the backside of the fabric, in which per warp yarn system a first pattern warp yarn extends alternately above a pair of weft yarns extending along the upper side of the fabric and between the weft yarns of a pair of weft yarns located along the backside of the fabric, and a second pattern warp yarn runs alternately between the weft yarns of a pair of weft yarns located along the upper side of the fabric and under a pair of weft yarns running along the bottom side of the fabric. A fabric is thus obtained of which both the upper side and the bottom side show a rib structure. In the course of the successive weft insertion cycles a rib line is produced alternately along the upper side and along the backside of the fabric. If the first and the second pattern warp yarn have a different color a two-color design or pattern can be made visible on the upper side of the fabric. On the backside of the fabric a type of negative (with swapped colors) is obtained of the design which is visible on the upper side of the fabric.

A disadvantage of this weaving method is that the fabrics woven according to this method only have a limited variation. The fabrics have the same rib structure over their entire surface and the patterns or designs woven therein only have two different colors.

SUMMARY OF THE INVENTION

The purpose of this invention is to provide a method for manufacturing a fabric with a rib structure, with which more variation can be brought into the appearance of the fabric.

This objective is achieved according to this invention if, with a method having the characteristics mentioned in the first paragraph of this specification, in a number of weft insertion cycles a loop-forming element is provided above the backing fabric and at least one pile warp yarn is loop-formingly passed around over this loop-forming element.

According to this method fabrics can be woven with a rib structure, in which areas with pile loops occur. A number of loops formed over the loop-forming element can be cut through so that areas with cut pile can also be obtained in the fabrics. These areas with cut pile may or may not be combined with areas with pile loops. According to this method a fabric can thus be woven with a combination of two or three different structures on the upper side.

These structure variations can be so provided that they form a certain figure, pattern or design in the fabric. Furthermore color variations can be achieved in the fabric by using different colored warp yarns, whereby warp yarn systems with two or more different colored warp yarns are provided in the fabric, whereby in each warp yarn system different warp yarns are allowed to form loops and/or ribs successively, in order to achieve a color variation in the fabric in accordance with a design, figure or pattern to be formed, and whereby the warp yarns with which no loops or ribs are formed in a certain place are woven into the backing fabric.

This method therefore enables fabrics with a rib structure to be manufactured with a much more varied appearance than according to the known weaving methods.

According to a preferred method according to this invention the loop-forming part of one or several loop-forming pile warp yarns is cut through, so that on the fabric at least one area with cut pile is obtained.

These warp yarns are preferably cut through by means of the loop-forming element. If a wire weaving machine is utilized cutting wires can be used for that purpose.

According to a particularly preferred method on the fabric with a rib structure at least one area with pile loops and at least one area with cut pile is also formed.

The fabric can best be woven on a wire weaving machine, whereby the aforesaid loop-forming elements are loop wires (for forming the pile loops) or wires with a blade (for forming cut pile).

The method according to this invention produces a fabric of good quality if for example in successive series of three weft insertion cycles in each case in the first cycle a first backing weft yarn, in the second cycle a second backing weft yarn, and in the third cycle a rib weft yarn is inserted between binding warp yarns and pile warp yarns, so that the aforesaid backing weft yarns and the binding warp yarns form a backing fabric, the aforesaid rib weft yarns run above this backing fabric, and the pile warp yarns are alternately interlaced in the backing fabric under a backing weft yarn and are rib-formingly passed around over a rib weft yarn.

Moreover for example in each case in the third cycle a loop-forming element can be provided above the backing fabric and the rib weft yarn, and loops can be formed in the fabric by alternately interlacing one or several pile warp yarns under a backing weft yarn in the backing fabric and loop-formingly passing it/them over a loop-forming element.

The loop-forming and the rib-forming pile warp yarns are with a very preferred weaving method according to this invention in each case interlaced in the backing fabric under the first backing weft yarn and run above the second backing weft yarn.

In order to obtain higher ribs and therefore a more pronounced rib effect a thicker weft yarn is used for the rib weft yarns than for the backing weft yarns.

In this method tight warp yarns are preferably also provided in the backing fabric.

Pile warp yarns or parts of pile warp yarns which do not form loops or ribs can be woven into the backing fabric.

The backing fabric is formed out of backing weft yarns and binding warp yarns, so that a layer of backing weft yarns is provided both above and below the tension warp yarns and/or the pile warp yarns woven in the backing fabric.

Another aspect of this invention is a fabric with a rib structure manufactured according to the method of this invention, such as described in the second paragraph of this specification, which also comprises at least one area with pile loops and/or at least one area with cut pile.

The fabric according to this invention is preferably manufactured according to the method according to this invention and is in its most preferred embodiment a so-called false bouclé carpet with cut pile and/or with pile loops.

In that which follows a possible method according to this invention is described in detail. The purpose of this specification is only to clarify further the aforesaid characteristics of the method and of the fabrics manufactured according to this method, and to specify further properties and distinctive features thereof, and may therefore in no way be considered as a restriction on the protection claimed for this invention in the claims of this patent application.

In this specification reference is made by means of reference numbers to the figures attached hereto, of which

DETAILED DESCRIPTION

Figure 1:
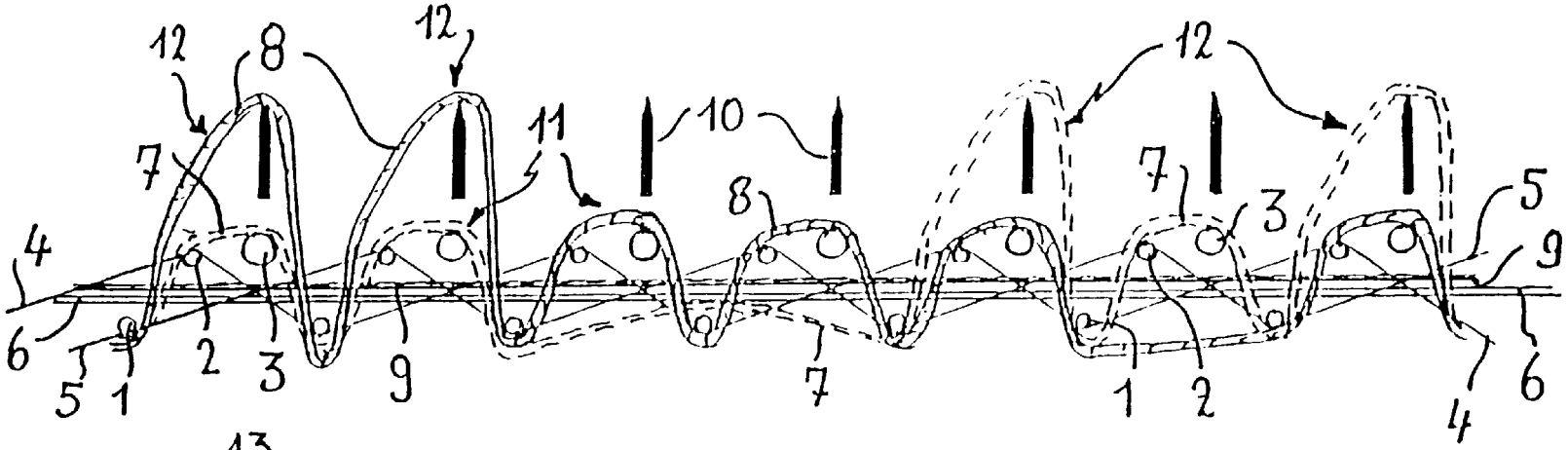
FIG. 1 is a schematic cross-section according to the warp direction of a part of a false bouclé carpet, in the course of the weaving thereof on a wire weaving machine according to a method according to this invention.

According to a preferred weaving method (see FIG. 1) according to this invention use is made of a known wire weaving machine with wires with a blade (10) and with a weft insertion mechanism that comprises a single rapier device which is controllable in order in each operating cycle to bring one respective weft yarn (1), (2), (3) through a shed between warp yarns (4–9).

On this weaving machine a series of warp yarn systems are provided, each of which comprises two binding warp yarns (4), (5), a tight warp yarn (6), and three pile warp yarns (7), (8), (9). On the weaving machine such a system of warp yarns is provided per space between reed dents.

In the course of the successive operating cycles of the weaving machine each warp yarn (4–9) is placed, by shed-forming means, at the correct heights in relation to the insertion level of the rapier device, so that these warp yarns (4–9) together with the weft yarns (1–3) form a fabric, in which the warp yarns (4–9) of each warp yarn system have the path in relation to the successive weft yarns (1–3) schematically represented in FIG. 1.

The weft yarns (1–3) are inserted in successive series of three successive weft insertion cycles, (in the figures the weft yarns (1–3) are represented which are inserted in the course of 7 successive series of weft insertion cycles), whereby in each case in the first cycle a first backing weft yarn (1) is inserted which for the formation of a backing fabric is woven in and extending below the tight warp yarns (6) by binding warp yarns (4), (5), in the second cycle a second backing weft yarn (2) is inserted which for the formation of the backing fabric is woven in and extending above the tight warp yarns (6) by binding warp yarns (4), (5), in the third cycle a rib weft yarn (3) is inserted which is not woven in the backing fabric extending above the backing fabric. The rib weft yarns (3) are thicker than the backing weft yarns (1), (2).

In order to obtain the rib structure, in each warp yarn system, in each series of weft insertion cycles, a pile warp yarn (7), (8) is brought under the first backing weft yarn (1) above the second backing weft yarn (2) and above the rib weft yarn (3). In the system represented in the figures in the course of the first and the second series of three weft insertion cycles ribs (11) are formed by a first pile warp yarn (7), in the course of the third, fourth and fifth series it is a second pile warp yarn (8) which forms the ribs (11), in the course of the sixth series a rib (11) is again formed by the aforesaid first pile warp yarn (7), and in the course of the seventh series it is again the second pile warp yarn (8) which forms a rib.

In the course of every third cycle the wire with a blade (10) of the wire weaving machine are provided above the weft insertion level. In order to form areas with loops (12), in a number of warp yarn systems, and in a number of series of weft insertion cycles, a pile warp yarn (7), (8) is brought under the first backing weft yarn (1), above the second backing weft yarn (2) and above the wire (10). In the system represented in the figures, in the course of the first and the second series of three weft insertion cycles loops (12) are formed by the aforesaid second pile warp yarn (8), while in the course of the fifth and the seventh series loops (12) are formed by the aforesaid first pile warp yarn (7).

The loops (12) are cut by means of the wires with a blade (10) of the weaving machine.

In this manner areas with cut pile are obtained in the fabric, so that apart from the bouclé effect (the rib structure) a so-called velvet effect (cut pile) is moreover also visible along the upper side of the fabric.

These effects are made according to a previously determined pattern. The pile warp yarns (9) which are not used for making these effects, are woven into the backing fabric, extending along tight warp yarns (6).

The backing weft yarns (1), (2) are woven in by the binding warp yarns (4), (5) on both sides of the tight warp yarns (6) and the pile warp yarns (9) extending along the tight warp yarns.

The thicker rib weft yarns (3) are interlaced above the tight warp yarns (6) and above the binding warp yarns (4), (5) by the pile warp yarns (7), (8) which form ribs (11) in that place in the fabric according to the previously determined pattern.

The path of a pile warp yarn (7), (8) which has to form false bouclé (ribs) is, in relation to the weft yarns (1), (2), (3) inserted in a series of weft insertion cycles, as follows: under the first backing weft yarn (1), above the second backing weft yarn (2) and above the thicker rib weft yarn (3).

The path of a pile warp yarn (7), (8) which has to form loops (12) differs therefrom only because of the fact that the pile warp yarn (7), (8) is brought above the cutting rod (10) in every third cycle.

The path of a pile warp yarn (7), (8) which does not have to form loops (12) or ribs (11) is, in relation to the weft yarns (1), (2), (3) of a series of insertion cycles, as follows: above the first backing weft yarn (1), under the second backing weft yarn (2) and under the thicker rib weft yarn (3). The usual binding in pattern can be modified for the dead pile warp yarns (7–9): namely when a pile warp yarn (7), (8) doesn't have to form ribs anylonger (11). Then the positions of the pile warp yarn (7), (8) can be, in relation to the weft yarns (1), (2), (3) of the next series of insertion cycles, as follows: under the first backing weft yarn (1), under the second backing weft yarn (2) and under the rib weft yarn (3).

If in place of wire with a blade (10) wires without a blade are provided, high pile loops (12) will be formed in the fabric. In that cases a fabric is obtained with a combination of the bouclé effect and the effect of high pile loops. A combination of wires and wires with a blade (10) can be provided on the weaving machine, through which fabrics with three different effects can be woven: bouclé effect, velvet effect, and the effect of high loops.

By alternating these effects designs can be formed or a well-defined pattern can be made visible in the fabric. In each of the effects color variations are furthermore also possible by allowing different colored pile warp yarns (7–9) to form ribs and/or loops.

Figure 2:
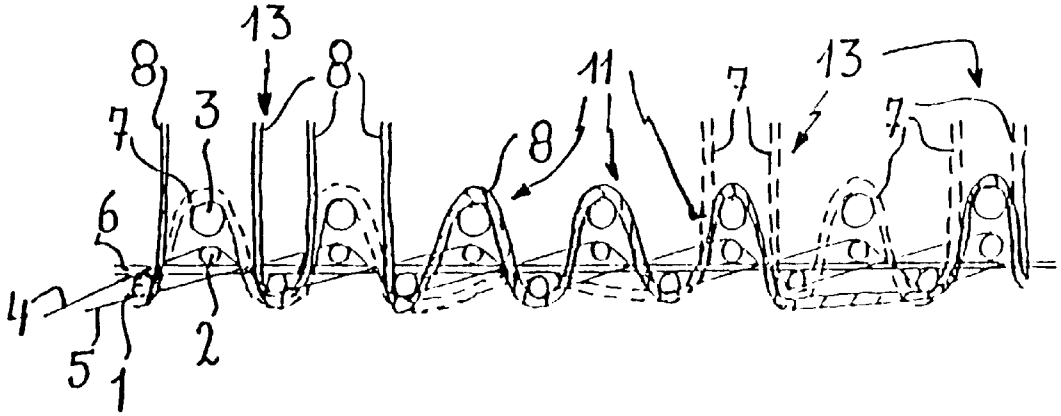
FIG. 2 is a schematic cross-section according to the warp direction of a part of a false bouclé carpet with areas with cut pile.

In FIG. 2 a schematic representation is shown of a cross-section according to the warp direction of a fabric manufactured according to the above described method with a combination of bouclé effect (ribs (11)) and velvet effect (cut pile (13)). Each cut loop (12) now forms two upright pile tufts. In the backing fabric the thicker rib weft yarn (3) comes to lie above the thinner second backing weft yarn (2), so that the ribs become still more clearly visible.

What is claimed is:

1. Method for weaving a fabric with a rib structure, whereby on a weaving machine a backing fabric is woven by bringing weft yarns (1), (2), (3) between warp yarns in successive weft insertion cycles, and whereby warp yarns (7), (8) are alternately inwoven in the backing fabric and are rib-formingly passed around over at least one weft yarn (3), characterized in that in a number of weft insertion cycles a loop-forming element (10) is provided above the backing fabric and at least one pile warp yarn (7), (8) is loop-formingly passed around over this loop-forming element (10).

2. Method for weaving a fabric with a rib structure according to claim 1 characterized in that cutting the loop-forming part (12) of one or several loop-forming pile warp yarns (7), (8) thereby obtaining on the fabric at least one area with cut pile (13).

3. Method for manufacturing a fabric with a rib structure according to claim 2 characterized in that the pile warp yarns (7), (8) are cut by means of the loop-forming element (10).

4. Method for manufacturing a fabric with a rib structure according to claim 2 characterized in that forming on the fabric with a rib structure at least one area with pile loops (12) and at least one area with cut pile (13).

5. Method for manufacturing a fabric with a rib structure according to claim 1 characterized in that the fabric is woven on a wire weaving machine, whereby the aforesaid loop-forming elements are wires or wires with a blade (10).

6. Method for manufacturing a fabric with a rib structure according to claim 1 characterized in that in successive series of three weft insertion cycles in each case in the first cycle a first backing weft yarn (1), in the second cycle a second backing weft yarn (2), and in the third cycle a rib weft yarn (3) is inserted between binding warp yarns (4), (5) and pile warp yarns (7), (8), (9), so that the aforesaid backing weft yarns (1), (2) and the binding warp yarns (4), (5) form a backing fabric, the aforesaid rib weft yarns (3) run above this backing fabric, and at least one pile warp yarn (7), (8) is alternately interlaced in the backing fabric under a backing weft yarn (1) and is rib-formingly passed around over a rib weft yarn (3).

7. Method for manufacturing a fabric with a rib structure according to claim 6 characterized in that in each case in the third cycle a loop-forming element (10) is provided above the backing fabric and the rib weft yarn (3), and that loops (12) are formed in the fabric by alternately interlacing one or several pile warp yarns (7), (8) under a backing weft yarn (1) in the backing fabric and loop-formingly passing the warp yarns over a loop-forming element (10).

8. Method for manufacturing a fabric with a rib structure according to claim 6 characterized in that the loop-forming and the rib-forming pile warp ends (7), (8) are in each case interlaced in the backing fabric under the first backing weft yarn (1) and run above the second backing weft yarn (2).

9. Method for manufacturing a fabric with a rib structure according to claim 1 characterized in that a thicker weft yarn is used for the rib weft yarns (3) than for the backing weft yarns (1), (2).

10. Method for manufacturing a fabric with a rib structure according to claim 1 characterized in that tightening warp yarns (6) are provided in the backing fabric.

11. Method for manufacturing a, fabric with a rib structure according to claim 1 characterized in that pile warp yarns (9) or parts of pile warp yarns which do not form loops (12) or ribs (11) are inwoven in the backing fabric.

12. Method for manufacturing a fabric with a rib structure according to claim 10 characterized in that the backing fabric is formed out of backing weft yarns (1), (2) and binding warp yarns (4), (5), so that a layer of backing weft yarns (1), (2) is provided both above and below the tight warp yarns (6) and/or the pile warp yarns (9) inwoven in the backing fabric.

13. Fabric with a rib structure in which warp yarns (7), (8) are alternately woven in the fabric and are rib-formingly passed around at least one weft yarn (3), characterized in that the fabric also comprises at least one area with cut pile (13) and/or at least one area with pile loops (12).

14. Fabric with a rib structure according to claim 13 characterized in that it is a false bouclé carpet.

* * * * *